US009427080B2

(12) United States Patent
Wu

(10) Patent No.: US 9,427,080 B2
(45) Date of Patent: Aug. 30, 2016

(54) COLLAPSIBLE POWER-DRIVEN TABLE STAND

(71) Applicants: TIMOTION TECHNOLOGY CO., LTD., New Taipei (TW); ADJUSTME sourcing ApS, Koege (DK)

(72) Inventor: Chou-Hsin Wu, New Taipei (TW)

(73) Assignees: TIMOTION TECHNOLOGY CO., LTD., New Taipei (TW); ADJUSTME SOURCING APS, Koege (DK)

( * ) Notice: Subject to any disclaimer, the term of this patent is extended or adjusted under 35 U.S.C. 154(b) by 0 days.

(21) Appl. No.: 14/886,473

(22) Filed: Oct. 19, 2015

(65) Prior Publication Data

US 2016/0037904 A1 Feb. 11, 2016

Related U.S. Application Data

(62) Division of application No. 14/276,998, filed on May 13, 2014, now Pat. No. 9,271,567.

(30) Foreign Application Priority Data

Apr. 3, 2014 (TW) ..... 103205883 U

(51) Int. Cl.
*A47B 3/08* (2006.01)
*A47B 3/00* (2006.01)
(Continued)

(52) U.S. Cl.
CPC . *A47B 3/08* (2013.01); *A47B 1/08* (2013.01); *A47B 1/10* (2013.01); *A47B 3/002* (2013.01); *A47B 9/00* (2013.01); *A47B 9/20* (2013.01); *A47B 13/02* (2013.01); *A47B 19/08* (2013.01); *A47B 13/06* (2013.01); *A47B 87/002* (2013.01); *A47B 2003/0821* (2013.01);
(Continued)

(58) Field of Classification Search
CPC ..... A47B 3/08; A47B 9/00; A47B 87/002
See application file for complete search history.

(56) References Cited

U.S. PATENT DOCUMENTS 3,082,712 A * 3/1963 Johnson ..... A47B 13/02 108/158.11
4,711,184 A * 12/1987 Wallin ..... A47B 9/10 108/147
(Continued)

FOREIGN PATENT DOCUMENTS

AT EP 2201860 B1 * 8/2012 ..... A47B 9/00
CA 2310506 C * 5/2004 ..... A47B 3/0815
(Continued)

*Primary Examiner* — Joshua J Michener
*Assistant Examiner* — Chiedu Chibogu
(74) *Attorney, Agent, or Firm* — Chun-Ming Shih; HDLS IPR Services

(57) ABSTRACT

A collapsible power-driven table stand includes a supporting body of an elongated shape, a first stand having a first driving member and a plurality of first extendable rods driven by the first driving member to move axially relative to each other and a second stand having a second driving member and a plurality of second extendable rods driven by the second driving member to move axially relative to each other. The first diving member is pivotally attached to one end of the supporting body and the second diving member is also pivotally attached to another end of the supporting body in order to allow both the first and second stands to extend/collapse relative to the supporting body. Accordingly, the assembly of the collapsible power-driven table is simplified and the overall size thereof is reduced.

5 Claims, 8 Drawing Sheets

(51) Int. Cl.

| | |
|---|---|
| ***A47B 19/08*** | (2006.01) |
| ***A47B 9/00*** | (2006.01) |
| ***A47B 9/20*** | (2006.01) |
| ***A47B 1/08*** | (2006.01) |
| ***A47B 1/10*** | (2006.01) |
| ***A47B 13/02*** | (2006.01) |
| *A47B 13/06* | (2006.01) |
| *A47B 87/00* | (2006.01) |

(52) U.S. Cl.
CPC ..... *A47B 2003/0827* (2013.01); *A47B 2200/0056* (2013.01); *A47B 2200/0061* (2013.01)

(56) References Cited

U.S. PATENT DOCUMENTS 4,748,913 A * 6/1988 Favaretto ..... A47B 17/00 108/50.02
5,078,055 A * 1/1992 Bellini ..... A47B 13/003 108/64
5,174,532 A * 12/1992 Huang ..... A47B 13/06 108/158.11
5,285,733 A * 2/1994 Waibel ..... A47B 9/20 108/147.19
5,400,721 A * 3/1995 Greene ..... A47B 9/02 108/147
5,598,790 A * 2/1997 Fich ..... A47B 13/02 108/158.11
6,024,024 A * 2/2000 Favaretto ..... A47B 17/00 108/157.1
6,415,723 B1 * 7/2002 Kopish ..... A47B 3/0815 108/128
6,595,144 B1 * 7/2003 Doyle ..... A47B 9/00 108/147
6,729,244 B2 * 5/2004 Cattaneo ..... A47B 13/02 108/155
8,967,054 B2 * 3/2015 Henriott ..... A47B 13/06 108/147.19
9,155,391 B2 * 10/2015 Klinke ..... A47B 9/20
2002/0046684 A1 * 4/2002 Lin ..... A47B 3/0815 108/133
2002/0112654 A1 * 8/2002 Cattaneo ..... A47B 13/02 108/155
2003/0198230 A1 * 10/2003 DuBarry ..... A47B 1/08 370/395.31
2004/0083932 A1 * 5/2004 Kottman ..... A47B 3/00 108/115
2007/0261614 A1 * 11/2007 Weissenrieder ..... A47B 13/003 108/158.12
2008/0276841 A1 * 11/2008 Brauning ..... A47B 13/02 108/154
2011/0168064 A1 * 7/2011 Jahnsen ..... A47B 9/00 108/147
2014/0367538 A1 * 12/2014 Widholzer ..... A47B 9/20 248/188.1

FOREIGN PATENT DOCUMENTS

CH EP 1884176 A2 * 2/2008 ..... A47B 3/08
CH EP 2163170 A2 * 3/2010 ..... A47B 13/02
CN 202653494 U 1/2013
CN 203435902 U 2/2014
DE EP 0482416 A1 * 4/1992 ..... A47B 13/003
DE 9207132 U1 * 9/1993 ..... A47B 87/002
DE 19530780 A1 * 2/1997 ..... A47B 13/02
DE 19541068 A1 * 5/1997 ..... A47B 87/002
DE 29802531 U1 * 5/1998 ..... A47B 87/002
DE 10019292 A1 * 10/2001 ..... A47B 9/04
DE 10030919 A1 * 1/2002 ..... A47B 13/003
DE 10048777 A1 * 4/2002 ..... A47B 13/003
DE EP 1920679 A1 * 5/2008 ..... A47B 3/08
DE WO 2009077130 A1 * 6/2009 ..... A47B 87/002
DE 102010046769 A1 * 3/2012 ..... A47B 9/00
DE 102010042973 A1 * 4/2012 ..... A47B 13/021
FR 2629697 A1 * 10/1989 ..... A47B 1/00
FR 2700254 A1 * 7/1994 ..... A47B 3/0818
GB 2308059 A * 6/1997 ..... A47B 13/003
GB 2445412 A * 7/2008 ..... A47B 87/002
NL FR 2668244 A1 * 4/1992 ..... A47B 87/002
NL 9002262 A * 5/1992 ..... A47B 87/002
NL EP 0707807 A2 * 4/1996 ..... A47B 13/02
TR WO 2012099552 A1 * 7/2012 ..... F16B 7/187
TW M316019 U 8/2007
TW M473743 U 3/2014

* cited by examiner

COLLAPSIBLE POWER-DRIVEN TABLE STAND

CROSS-REFERENCE TO RELATED APPLICATION

This application is a divisional application of U.S. patent application Ser. No. 14/276,998, filed on May 13, 2014, and entitled "COLLAPSIBLE POWER-DRIVEN TABLE STAND". The entire disclosures of the above application are all incorporated herein by reference.

BACKGROUND OF THE INVENTION

1. Field of the Invention

The present invention is related to a power-driven table stand, in particular, to a collapsible power-driven table stand.

2. Description of Related Art

Ergonomic designs are known to be the design trend based on the concept associated with human bodies and shapes such that the design is able to provide the most optimal solution according to different shape and sizes of the user; therefore, mass produced products can also be incorporated into various types of adjustment structures therein for its use in order to satisfy the needs of different users. Among these products, the lifting mechanism of table is also one of the realizations for the application of the ergonomic design, which is able to adjust the height of the table in order to suit to the needs of different body heights and to achieve most optimal comforts. Therefore, the table with lifting function with adjustments has become one of the main trends in the modern designs.

In the currently existing power-driven tables lifting mechanisms, a portion of these tables use pneumatic cylinders for the stands and utilize the control on the lifting of the pneumatic cylinders to achieve the adjustments on the position of the heights. Although these tables have the characteristic of simplified assembly in their structures, due to the lifting of the pneumatic cylinders at high speed in the operation as well as the requirement of the manual actions of lowering the pneumatic cylinders by the user during the lowering thereof, improper forces exerted by the user can often lead to extremely large differences in the heights of the table, which cannot satisfy the needs of the user and often requires numerous attempts on the adjustments of lifting and lowering until a suitable height of the table can be obtained; in other words, the effectiveness of these tables are poor.

Another portion of power-driven tables use power-driven cylinders for the stands. Although such solution can effectively overcome the difficulties in the aforementioned adjustments on the positions of the heights of the tables, it has the drawbacks of a complicated structure, tedious and time-consuming assembly, heavy weight, large size and so on, that need to be overcome.

SUMMARY OF THE INVENTION

An objective of the present invention is to provide a collapsible power-driven table stand capable of simplifying the assembly procedure of the user and having a compact structure for reducing the overall size of thereof.

To achieve the aforementioned objective, the present invention provides a collapsible power-driven table stand comprising a supporting body, a first stand and a second stand. The supporting body is of an elongated shape. The first stand comprises a first driving member and a plurality of first extendable rod driven by the first driving member to move axially relative to each other. The first driving member is pivotally attached to one end of the supporting body in order to allow the first stand to extend or collapse relative to the supporting body. The second stand comprises a second driving member and a plurality of second extendable rod driven by the second driving member to axially move relative to each other. The second driving member is pivotally attached to another end of the supporting body in order to allow the second stand to extend or collapse relative to the supporting body.

The present invention further includes the following merits. With the characteristic of having each one of the stands configured to be bendable and extendable, the overall size of the structure after collapsing can be significantly reduced in order to save the use of packaging materials and to lower the transportation costs. By utilizing the characteristic of common structural members for the assembly, the use of the material can be reduced in addition to that the costs of the component and storage management can be further reduced as well. As the driving members and the controllers are concealed inside the receiving slots of the supporting body and the head portions of the screws are also concealed inside the rectangular columns, the beauty of the overall outer appearance can be achieved with appealing effects.

DETAILED DESCRIPTION OF THE INVENTION

Figure 1:
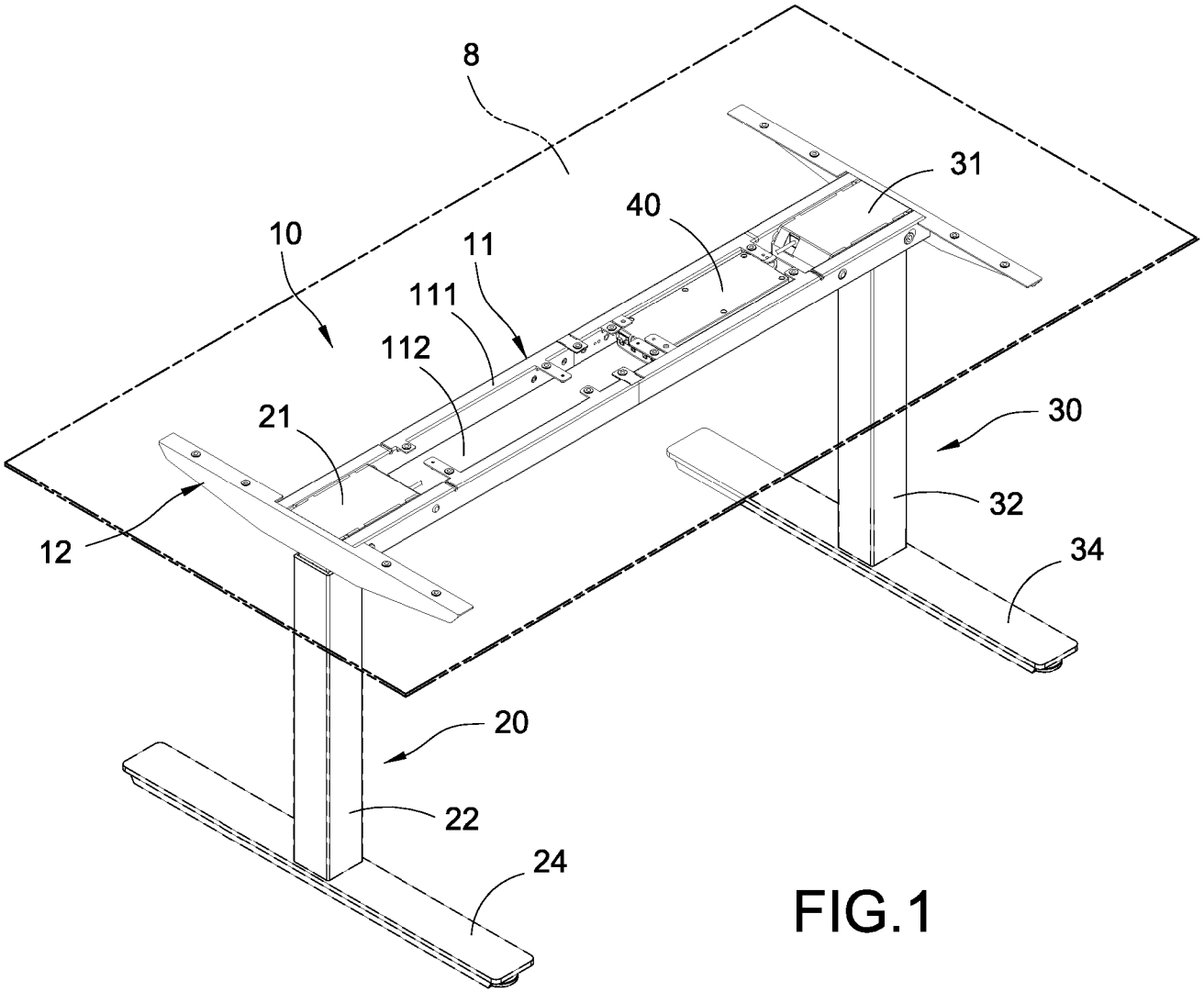
FIG. 1 is a perspective outer view of the power-driven table stand the present invention.

The following provides detailed description of embodiments of the present invention along with the accompanied drawings. It can, however, be understood that the accompanied drawings are provided for illustrative purposes only and shall not be treated as limitations to the present invention.

Please refer to FIG. 1 to FIG. 4. The present invention provides a collapsible power-driven table stand mainly comprising a supporting body 10, a first stand 20 and a second stand 30.

The supporting body 10 is of an elongated shape and mainly comprises a lateral bracket 11 and two side wings 12. The lateral bracket 11 includes two rectangular columns 111 spaced apart from each other and connected in parallel; a receiving slot 112 is formed between the two rectangular columns 111; two end surfaces of each rectangular column 111 include a rectangular insertion hole 113 formed thereon respectively. In addition, each side plate of the rectangular column 111 includes an inner side hole 114 and an outer side hole 115. Furthermore, a bottom plate of the rectangular column 111 includes a plurality of perforations 116.

The side wing 12 is generally of a T shape and comprises a fixation plate 121 and two U-shaped members 122 secured onto a mid-section area of the fixation plate 121. The fixation plate 121 is provided for a table top 8 to be fastened thereon. Each U-shaped member 112 is inserted into the aforementioned insertion hole 113 correspondingly; in addition, a lateral side of the U-shaped member 122 includes a through hole 123 corresponding to the aforementioned outer side hole 115, and a bottom surface of the U-shaped member 122 includes a plurality of screw holes 124 corresponding to the aforementioned perforations 116 in order to allow fastening units such as screws to fasten thereon.

The first stand 20 is generally of an L shape and comprises a first driving member 21 and a plurality of extendable rods 22 connected to the first driving member 21. The first driving member 21 mainly comprises a rectangular housing 211 for accommodating components including such as a motor, a speed reduction mechanism, such as a worm shaft and worm gear set or reduction gear set, and leading screw shaft (not shown in the figures) penetrating through the housing 211 to the external thereof. The housing 211 includes a protruding platform 212 formed at an inner corner position thereof. The center position of the protruding platform 212 includes a first screw hole 213; the housing 211 is received inside the aforementioned receiving slot 112 and is fastened by fastening units 23, such as screws, penetrating through the inner side hole 114 and further fastened onto the first screw hole 213 such that the first stand 20 is able to use it as a rotational center to perform rotations and swings for extension or collapsing relative to the supporting body 10. In addition, the housing 211 includes a second screw hole 214 at a top of the first extendable rod 22; when the first stand 20 is rotated to extend relative to the supporting body 10 and perpendicular to the lateral bracket 11, it can be fastened by fastening units 23, such as screws, penetrating through the outer side hole 115 and further fastened onto the second screw hole 214.

In this embodiment, the structure is constructed by three first extendable rods 22 to form a three-staged extendable structure, which can also be a two-staged or four-staged extendable structure. Each first extendable rod 22 is driven by the aforementioned motor and the leading screw shaft to be able to move axially relative to each other in order to achieve the extension or retraction thereof.

Preferably, the first stand 20 further comprises a first bottom plate 24. The first bottom plate 24 uses fastening units, such as screws, to be fastened onto the bottom surface of the outer most first extendable rod 22.

The second stand 30 comprises a second driving member 31 and a plurality of second extendable rods 32 driven by the second driving member 31 to move axially relative to each other. The second driving member 31 is pivotally attached to the supporting body 10 in order to allow the second stand 30 to extend or collapse relative to the supporting body 10. Since the second driving member 31 and the second extendable rods 32 have structures identical to those of the first driving member 21 and the first extendable rods 22 in addition to that the second bottom plate 34 is of an identical structure as that of the first bottom plate 24, similar details thereof are omitted hereafter.

Preferably, the collapsible power-driven table stand of the present invention further comprises a controller 40. The controller 40 is also received inside the receiving slot 112 and is electrically connected to the first driving member 21 and the second driving member 31. With the utilization of the controller 40, a synchronous actuation of the first driving member 21 and the second driving member 31 can be achieved.

Figure 2:
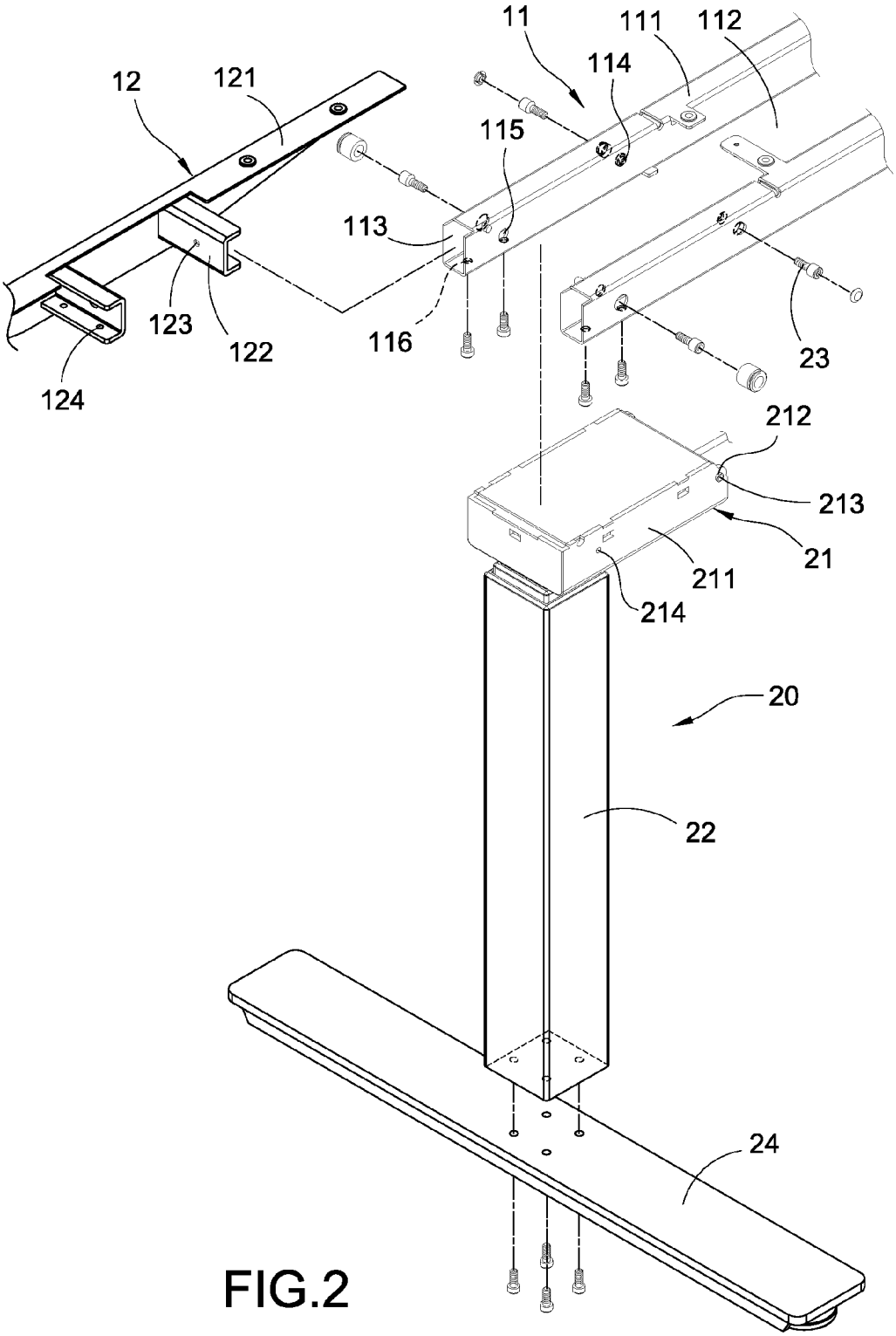
FIG. 2 is an exploded perspective view of the supporting body and the first stand of the present invention.
Figure 3:
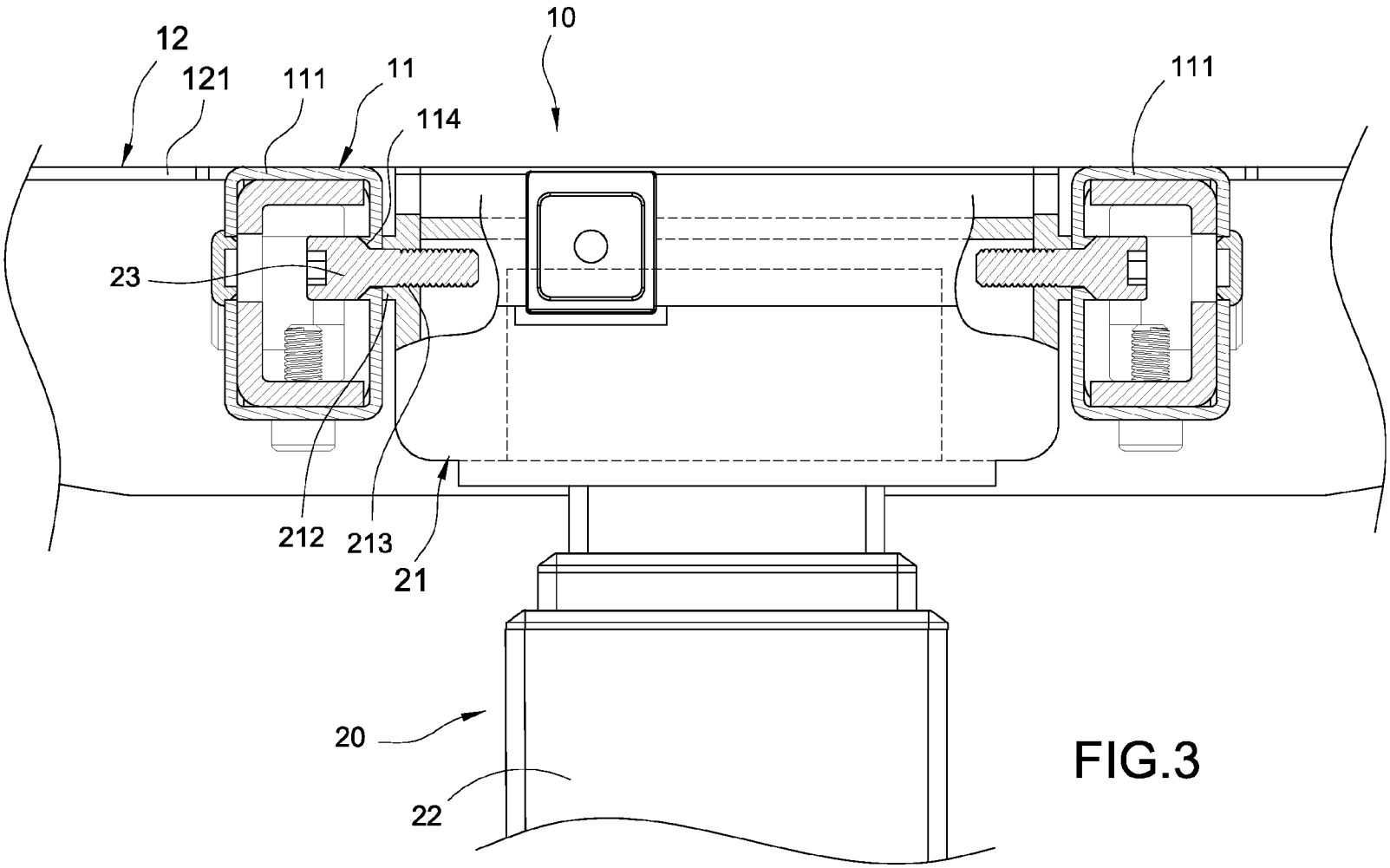
FIG. 3 is a cross sectional view of the supporting body and the first stand of the present invention.
Figure 4:
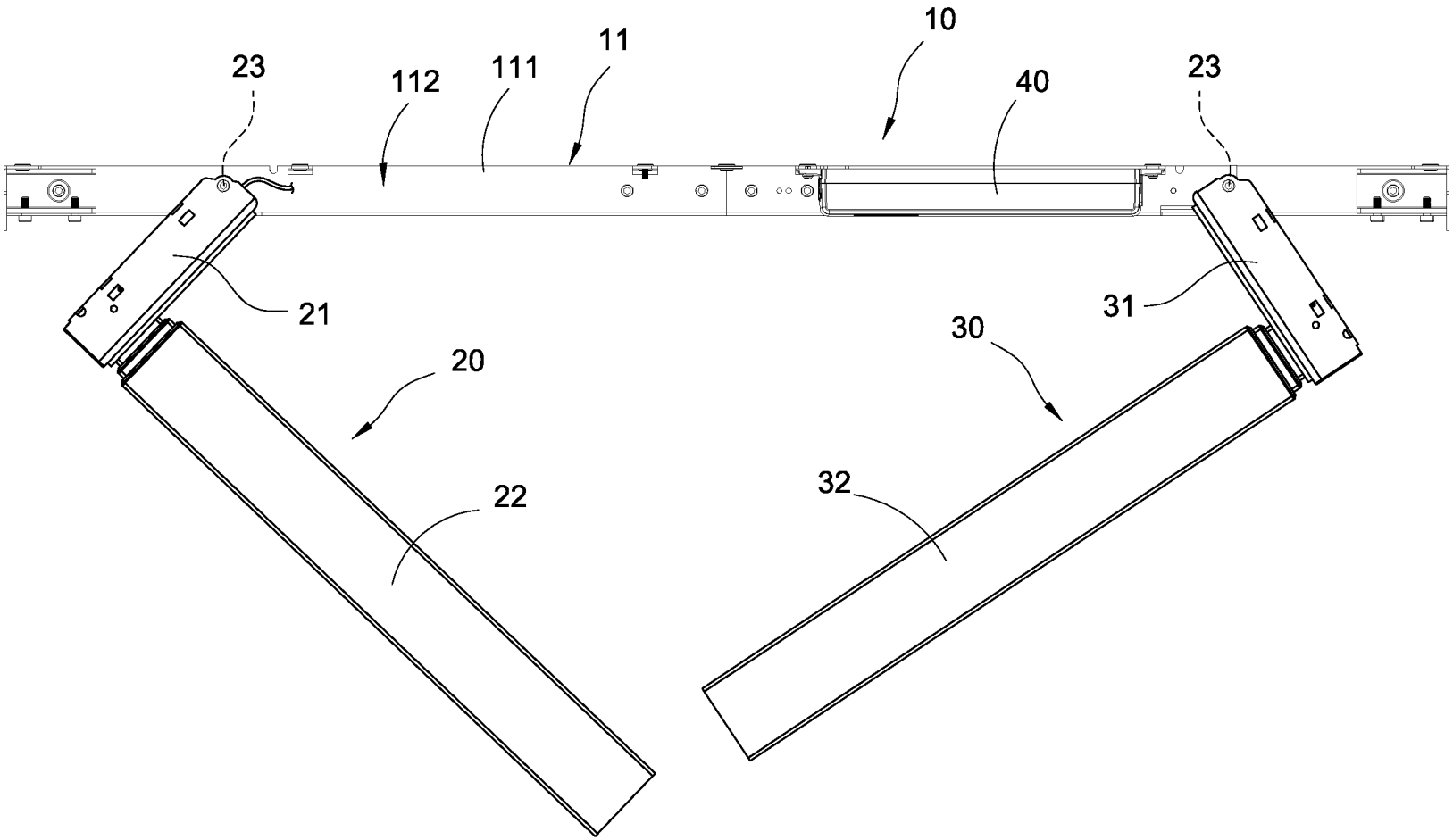
FIG. 4 is an illustration showing the supporting body and the stands of the present invention during the collapsing thereof for storage.
Figure 5:
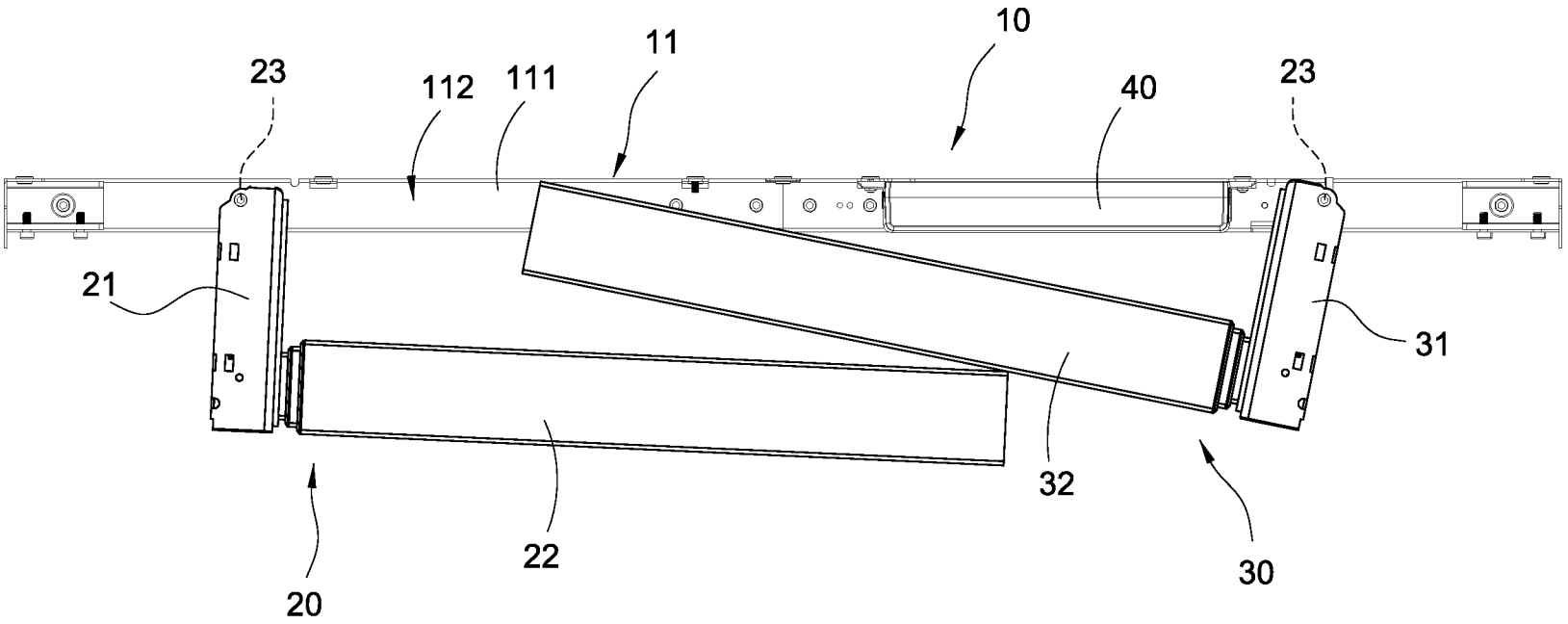
FIG. 5 is an illustration showing the supporting body and the stands of the present invention after the completion of the collapsing thereof for storage.
Figure 6:
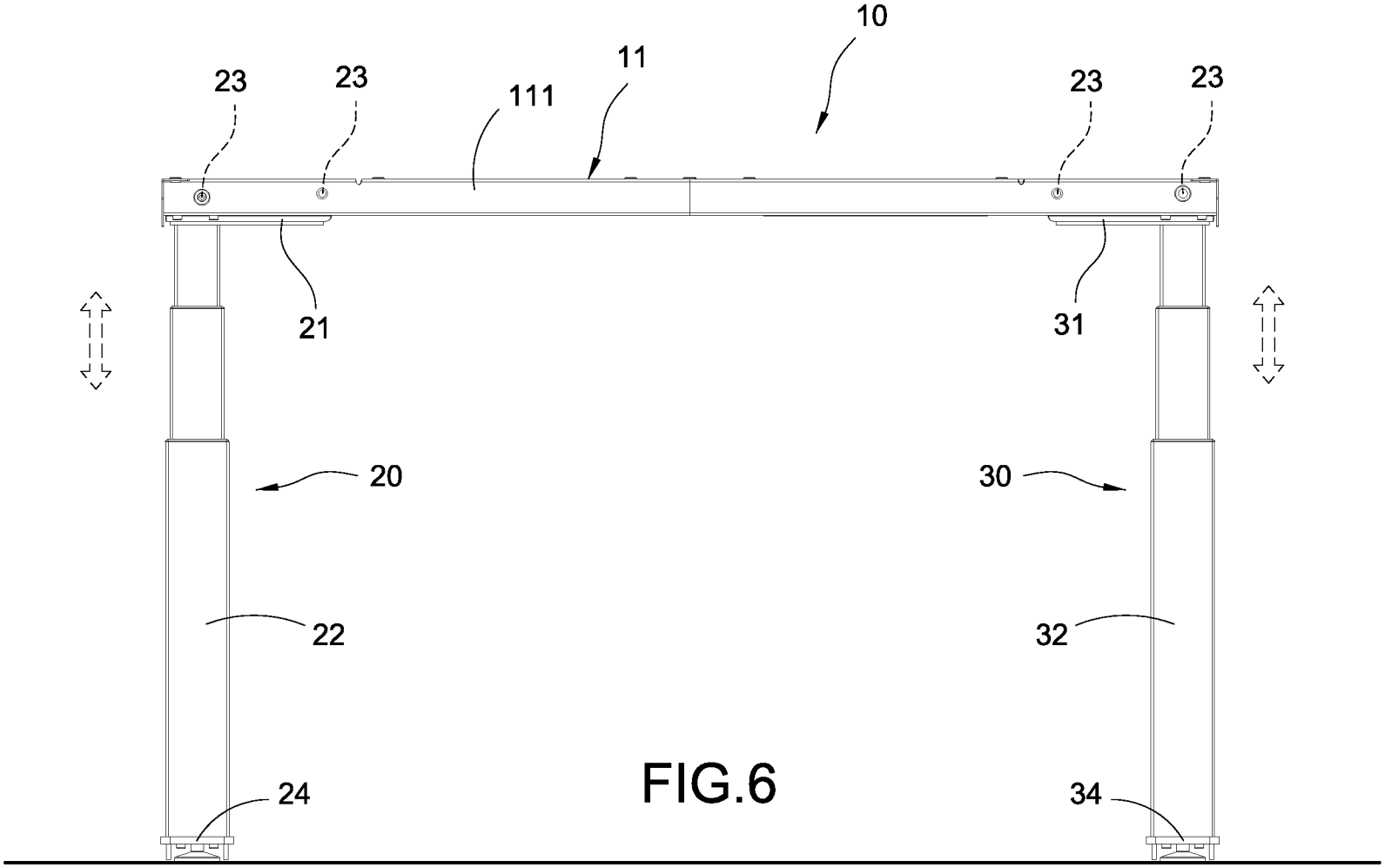
FIG. 6 is an illustration showing a state of use of the stands of the present invention.

Please refer to FIG. 5 and FIG. 6. With the combination of the aforementioned assembly, during the collapsing for storage of the present invention, the pivotal rotational area of the second stand 30 is used as a rotation center for rotating the end portions of the second extendable rods 32 into the receiving slot 112, followed by using the pivotal rotational area of the first stand 20 as a rotation center for rotating the first extendable rods 22 therein and to use its end portions to abut against the second extendable rods 32; therefore, the action of the collapsing for storage can be completed swiftly with ease. On the contrary, when the user wishes to use the present invention, the first extendable rods 22 and the second extendable rods 32 are rotated out in sequence, and the U-shape member 122 of each side wing 12 is inserted into the insertion hole 113 of the rectangular column 111 correspondingly, as shown in FIG. 2, followed by using the fastening units 23 to sequentially penetrate through the outer side hole 115 and the through hole 123 in order to be further fastened onto the second screw hole 214. Accordingly, with such configuration, the costs associated with the formation of the screw holes can be reduce and the head portions of the fastening units 23 are allowed to be concealed inside the rectangular columns 111 such that the beauty of the overall outer appearance can be achieved.

Furthermore, as the controller 40 is electrically connected to the first driving member 21 and the second driving member 31, it is able to simultaneously drive the first extendable rods 22 and the second extendable rods 32 to perform synchronous actions of retraction and extension, as shown in FIG. 6.

Figure 7:
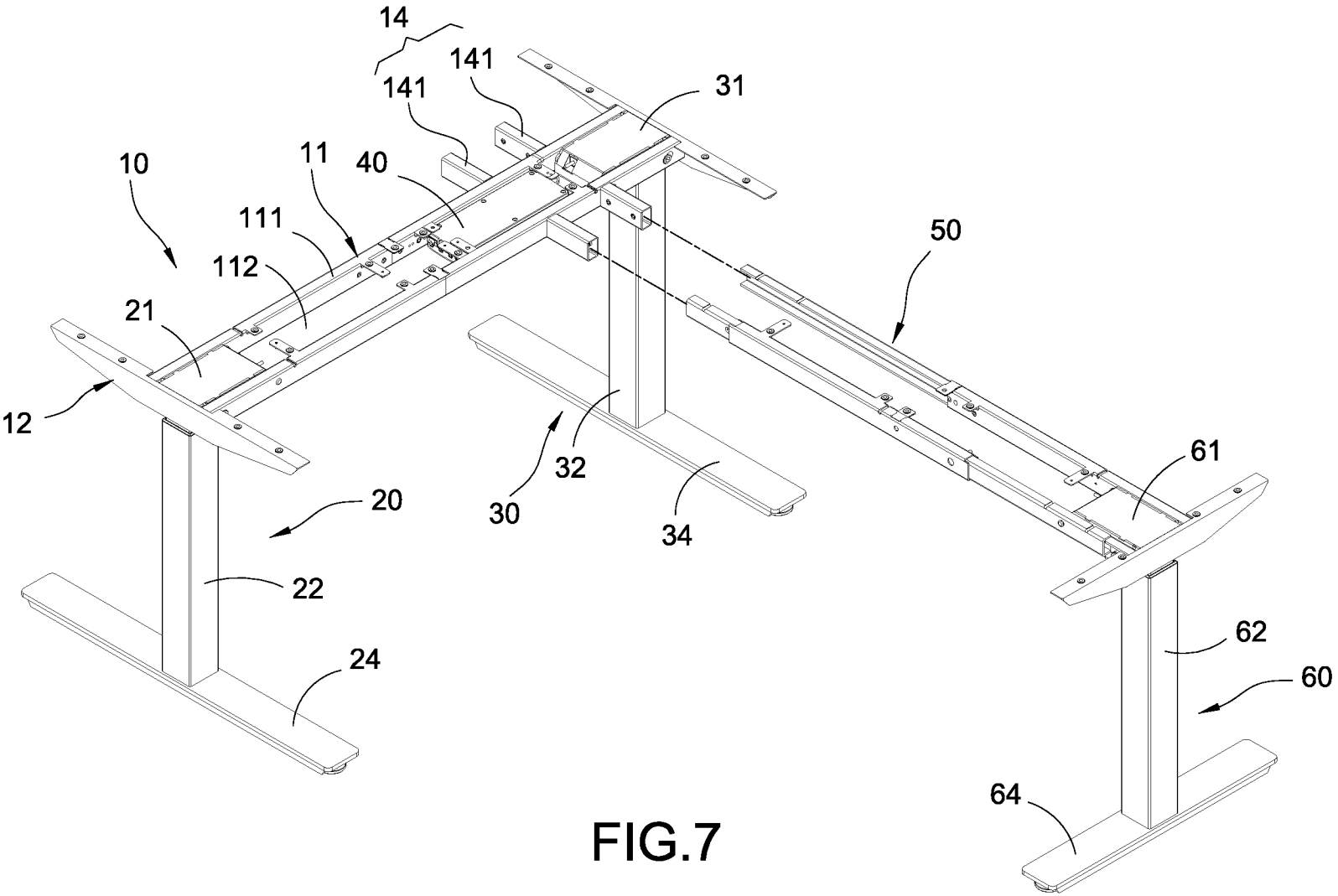
FIG. 7 is an exploded view of parts of the components of another embodiment of the present invention.
Figure 8:
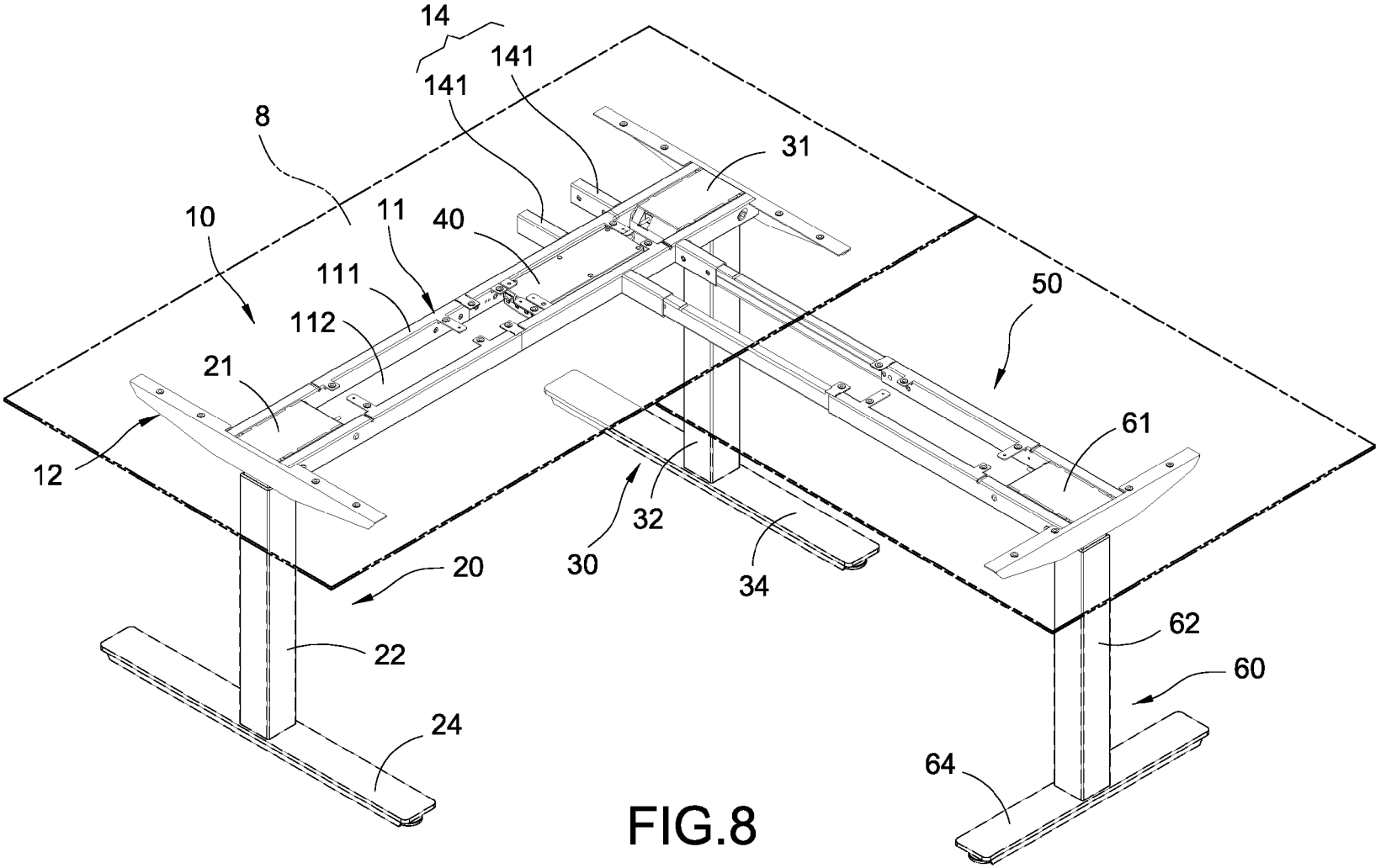
FIG. 8 is an illustration showing the assembly of another embodiment of the present invention.

Please refer to FIG. 7 and FIG. 8. In addition to the aforementioned embodiment of the collapsible power-driven table stand of the present invention, according to another embodiment of the present invention, it can further comprises a longitudinal bracket 50 and a third stand 60; wherein the supporting body further comprises a supporting structure 14. The supporting structure 14 can include two pairs of hollow columns 141, and each hollow column 141 is soldered to the outer surfaces of two rectangular columns 111 in a direction perpendicular to the rectangular columns 111. One end of the longitudinal bracket 50 penetrates through one of the pairs of the hollow columns 141. The third stand 60 comprises a third driving member 61 and a plurality of extendable rods 62 driven by the third driving member 61 to move axially relative to each other. The third driving member 61 is pivotally attached to one end of the longitudinal bracket 50 away from the hollow column 141. The aforementioned controller 40 is electrically connected to the third driving member 61 in order to achieve the synchronous actuation with the first driving member 21 and the second driving member 31.

In addition, the structure of the longitudinal bracket 50 is identical to that of the aforementioned lateral bracket 11, and the third stand 60 is also of a structure identical to that of the first stand 20 or the second stand 30; likewise, the third bottom plate 64 has a structural identical to that of the first bottom plate 24 or the second bottom plate 34. With such configuration, the characteristic of the common components among these assembly structures yields a great reduction on the cost.

In view of the above, the collapsible power-driven table stand of the present invention can indeed achieve the expected objectives and results while overcoming the drawbacks of the prior arts. The above descriptions on the embodiments of the present invention are provided for illustrative purposes only, which shall not be treated as limitations of the present invention. Any other equivalent modifications within the spirit of the present invention shall be deemed to be within the scope of the present invention.

What is claimed is:

1. A collapsible power-driven table stand, comprising:

a supporting body having an elongated shape;

a first stand comprising a first driving member and a plurality of first extendable rods driven by the first driving member to move axially relative to each other; the first driving member pivotally attached to one end of the supporting body in order to allow the first stand to extend or collapse relative to the supporting body;

a second stand comprising a second driving member and a plurality of second extendable rods driven by the second driving member to move axially relative to each other; the second driving member pivotally attached to another end of the supporting body in order to allow the second stand to extend or collapse relative to the supporting body;

a longitudinal bracket and a third stand; wherein two ends of the longitudinal bracket are connected to the supporting body and the third stand respectively, the third stand comprises a third driving member and a plurality of third extendable rods driven by the third driving member to move axially relative to each other, and the third driving member is pivotally attached to the longitudinal bracket; and a controller electrically connected to the first driving member, the second driving member and the third driving member in order to control a synchronous actuation of the first driving member, the second driving member and the third driving member wherein the supporting body comprises a lateral bracket having a plurality of rectangular columns spaced apart from each other and connected in parallel; a receiving slot is formed between the rectangular columns, and the controller is concealed inside the receiving slot;

wherein the supporting body further comprises a side wing having a fixation plate and a U-shaped member secured on the fixation plate; an end surface of each rectangular column includes an insertion hole formed therein; the U-shaped member is inserted into the insertion hole.

2. The collapsible power-driven table stand according to claim 1, wherein the supporting body comprises a supporting structure having a pair of hollow columns; each of the hollow columns is connected in a direction perpendicular to the rectangular columns; one end of the longitudinal bracket is attached to the pair of hollow columns.

3. The collapsible power-driven table stand according to claim 1, wherein each rectangular column includes an inner side hole formed therein; the first driving member comprises a housing, and a surface of the housing includes a protruding platform formed thereon; the protruding platform includes a first screw hole; the housing is received inside the receiving slot and a fastening unit penetrates through the inner side hole and is fastened in the first screw hole.

4. The collapsible power-driven table stand according to claim 3, wherein each rectangular column includes an outer side hole formed therein; the U-shaped member includes a through hole corresponding to the outer side hole; the housing includes a second screw hole and a fastening unit penetrates through the outer side hole and is fastened in the second screw hole.

5. The collapsible power-driven table stand according to claim 1, wherein the first stand comprises a first bottom plate connected to one end of the first extendable rods away from the first driving member.

* * * * *